United States Patent [19]

Okamoto et al.

[11] 4,098,162

[45] Jul. 4, 1978

[54] SYNTHESIZER TYPE ELECTRONIC MUSICAL INSTRUMENT

[75] Inventors: Eisaku Okamoto; Kiyoshi Ichikawa, both of Hamakita, Japan

[73] Assignee: Nippon Gakki Seizo Kabushiki Kaisha, Japan

[21] Appl. No.: 749,224

[22] Filed: Dec. 10, 1976

[30] Foreign Application Priority Data

Dec. 15, 1975 [JP] Japan ..... 50-148433

[51] Int. Cl.[2] ..... G10H 1/00; G10H 5/00

[52] U.S. Cl. ..... 84/1.01; 84/DIG. 2; 84/DIG. 8; 84/DIG. 20; 84/DIG. 23

[58] Field of Search ..... 84/1.01, DIG. 2, DIG. 8, 84/DIG. 20, DIG. 23

[56] References Cited

U.S. PATENT DOCUMENTS

| | | | |
|---|---|---|---|
| 3,880,039 | 4/1975 | Studer | 84/1.01 |
| 3,898,905 | 8/1975 | Schreier | 84/1.01 |
| 3,906,830 | 9/1975 | Mathias | 84/1.01 |
| 4,016,792 | 4/1977 | Schrecongost | 84/1.01 |

*Primary Examiner*—Stanley J. Witkowski
*Attorney, Agent, or Firm*—Flynn & Frishauf

[57] ABSTRACT

An electronic musical instrument includes a pitch determining voltage signal generating circuit adapted to produce one of 12 pitch determining voltage signals having different magnitudes corresponding to 12 notes in one octave in response to any of keys belonging to different octave ranges in a keyboard and having the same note name. A pitch determining voltage signal common to the different octave ranges is converted by a voltage converting circuit and taken out as a voltage signal having a magnitude corresponding to the note of a key being depressed on the keyboard. The voltage converting circuit includes a voltage dividing network having a plurality of output points and gate circuits connected to the output points, respectively. Each gate circuit is enabled in response to the depression of a key belonging to a corresponding octave range. Alternatively, the voltage converting circuit is constructed of a variable gain amplifier whose voltage gain is controlled dependent upon the octave range to which a key being depressed belongs.

6 Claims, 6 Drawing Figures

SYNTHESIZER TYPE ELECTRONIC MUSICAL INSTRUMENT

This invention relates to an electronic musical instrument, and in particular to a synthesizer type electronic musical instrument.

FIG. 1 shows a conventional synthesizer type electronic musical instrument by way of example. Reference numeral 11 shows a keyboard circuit which produces a pitch determining voltage signal having a magnitude corresponding to the note of a key depressed on the keyboard, and a trigger signal representative of the key depression. The pitch determining voltage signal from the keyboard circuit 11 is coupled to a voltage-controlled variable frequency oscillator (hereinafter referred to as "VCO") 12 to generate a tone signal corresponding to the note of a key being depressed on the keyboard. The tone signal of VCO 12 is applied to a voltage-controlled filter (hereinafter referred to as "VCF") 13. VCF 13 is controlled by the pitch determining voltage signal to have a cutoff frequency according to its voltage value. The output of VCF 13 is coupled through a voltage-controlled variable gain amplifier (hereinafter referred to as VCA) 14 to a sound producing system including a power amplifier 15 and loudspeaker 16.

A trigger signal from the keyboard circuit 11 is coupled to control waveform generators 17, 18 and 19 to start the generation of control waveforms whose voltage values vary as a function of time. The output control waveforms of the control waveform generators 17, 18 and 19 are coupled to VCO 12, VCF 13 and VCA 14, respectively. As a result, the oscillation frequency of VCO 12, cutoff frequency of VCF 13 and voltage gain of VCA 14 are varied according to the shapes of the corresponding control waveforms. In order for a player to change arbitrarily the shapes of the control waveforms from the control waveform generators 17, 18 and 19 a parameter controlling voltage generator 20 is coupled to the control waveform generators 17, 18 and 19.

To meet the equally tempered musical scale it is required that the voltage value of the pitch determining voltage signals from the keyboard circuit 11 be exponentially varied in the order of tonal pitch. That is, since in the equally tempered musical scale the frequency ratio of the adjacent two tones is $2^{1/12}$, it is required that the keyboard circuit generate voltage signals according to a frequency relation of the equally tempered musical scale. That is, it is required that the voltage ratio of pitch determining voltage signals corresponding to the two adjacent keys on the keyboard be $2^{1/12}$.

FIG. 2 shows a conventional keyboard circuit by way of example. Single-pole double-throw key switches $S_1$, $S_2$, $S_3$ . . . are serially connected with respect to movable contacts and normally closed fixed contacts. The normally open fixed contact of each switch is connected to a corresponding voltage division point in a voltage dividing network including resistors *r*, $R_0$ and $R_1$. To meet the equally tempered musical scale the resistive values of the resistors r, $R_0$ and $R_1$ must satisfy the following relations.

$$(r/R_0 = 2^{1/12} - 1$$

$$R_1/R = 2^{1/12} + 2^{-1/12} - 2$$

Typical resistive values of the resistors *r*, $R_0$ and $R_1$, which substantially satisfy these relations, are as follows:

$r = 100$ ohms $R_0 = 1{,}681$ kiloohms $R_1 = 30$ kiloohms

To generate a pitch determining voltage signal having an accurate magnitude according to a corresponding note it is necessary for each resistor in the voltage dividing network to have an adequate accuracy. Because the keyboard has usually keys ranging over a plurality of octaves, resistors in the voltage dividing network are necessarily increased in number. In consequence, the conventional keyboard circuit has the disadvantage of requiring many resistors having an adequate accuracy. The same thing is also true for a keyboard circuit using a voltage dividing network other than the voltage dividing network shown in FIG. 2.

It is accordingly the object of this invention to provide an electronic musical instrument having a keyboard circuit which is capable of decreasing the number of resistors necessary to generate a pitch determining voltage signal corresponding to each note, as compared with a conventional keyboard circuit.

SUMMARY OF THE INVENTION

According to this invention there is provided an electronic musical instrument comprising keyboard means having keys over a plurality of octave ranges; pitch determining voltage signal generating means operatively coupled to the keyboard means for generating one of 12 pitch determining voltage signals having different magnitudes corresponding to 12 notes in one octave range in response to the depression of any one of keys belonging to different octave ranges and having the same note, voltage converting means coupled to an output of the pitch determining voltage signal generating means and operatively coupled to the keyboard means to provide a note-and-octane determining voltage signal having a magnitude corresponding to the note of a key being depressed in response to the octave range to which the key being depressed belongs and the pitch determining voltage signal common to the different octave ranges supplied from the pitch determining voltage signal generating means, and voltage-controlled oscillator means coupled to an output of the voltage converting means to generate a tone signal corresponding to the key being depressed.

DETAILED DESCRIPTION

One embodiment of this invention will be explained, by way of example, in connection with an electronic musical instrument having a keyboard compass of three octaves.

Figure 1:
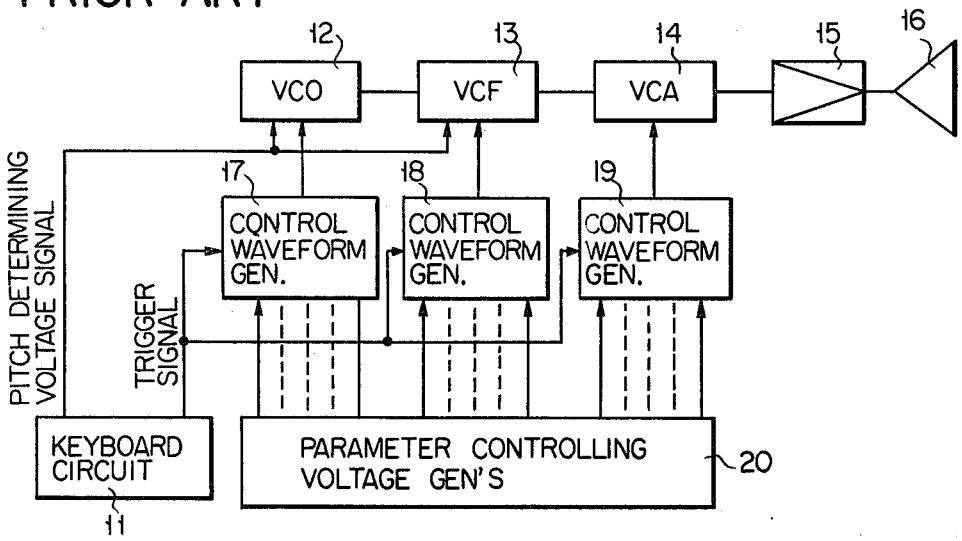
FIG. 1 PRIOR ART
FIG. 1 is a block diagram of a conventional synthesizer type electronic musical instrument.
Figure 2:
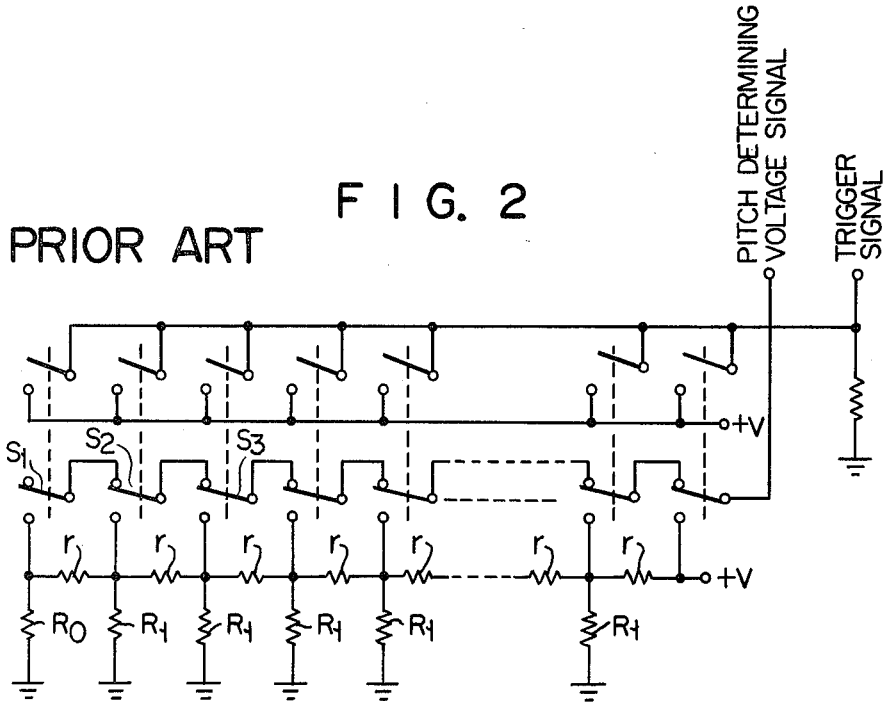
FIG. 2 PRIOR ART
FIG. 2 shows one configuration of a conventional keyboard circuit used in the synthesizer type electronic musical instrument.
Figure 3:
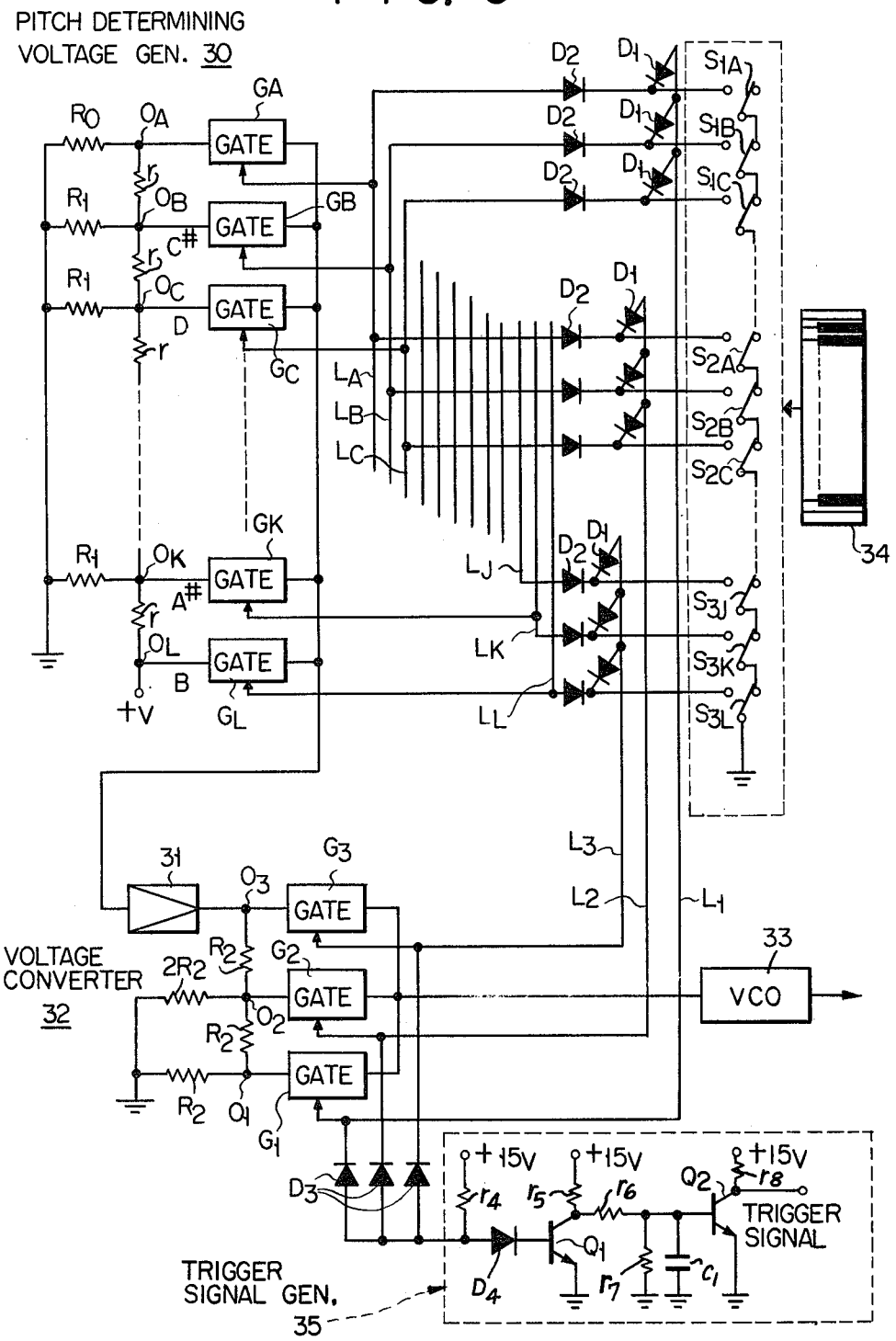
FIG. 3 is a synthesizer type electronic musical instrument embodying this invention.

In FIG. 3 reference numeral 30 is a pitch determining voltage signal generating circuit having a voltage dividing resistance network comprised of resistors $r$, $R_0$ and $R_1$ having the above-mentioned relations. The pitch determining voltage signal generating circuit 30 is constructed to produce 12 pitch determining voltage signals corresponding to 12 notes, for example, in the highest octave. In consequence, the voltage dividing network has 12 output points $O_A$ to $O_L$. The output points $O_A$ to $O_L$ are coupled respectively through gate circuits $G_A$ to $G_L$ to a buffer amplifier 31 having a gain of unity. To the output of the buffer amplifier 31 are connected a voltage converter 32 including a voltage dividing network comprised of resistors $R_2$ and $2R_2$ and having three output points $O_1$, $O_2$ and $O_3$ corresponding to the three octave ranges, and gate circuits $G_1$, $G_2$ and $G_3$ connected between the respective output points and VCO 33.

Single-pole double-throw key switches actuated by keys on a keyboard 34 are connected in series configuration as shown in FIG. 3. The key switches $S_{1A}$, $S_{1B}$, $S_{1C}$ . . . are actuated by the keys belonging to a first or lowest octave range. The key switches $S_{2A}$, $S_{2B}$, $S_{2C}$. . . are actuated by keys belonging to the second octave range and the key switches . . . $S_{3J}$, $S_{3K}$ and $S_{3L}$ are actuated by keys belonging to the third or highest octave range. The movable contact of the key switch $S_{3L}$ is connected to ground.

The normally open fixed contacts of the key switches $S_{1A}$, $S_{1B}$, $S_{1C}$. . . belonging to the first octave are connected respectively through diodes $D_1$ to an octave line $L_1$ connected to a control input of the gate circuit $G_1$, and the normally open fixed contacts of the key switches $S_{2A}$, $S_{2B}$, $S_{2C}$. . . belonging to the second octave are connected respectively through diodes $D_1$ to an octave line $L_2$ connected to a control input of the gate circuit $G_2$. The normally open fixed contacts of the key switches . . . $S_{3J}$, $S_{3K}$ and $S_{3L}$ belonging to the third octave are connected respectively through diodes $D_1$ to an octave line $L_3$ connected to a control input of the gate circuit $G_3$. Each of the normally open fixed contacts of key switches actuated by keys corresponding to the same notes in the first to third octave ranges is connected through a diode $D_2$ to a corresponding one of 12 note lines $L_A$ to $L_L$. The lines $L_A$ to $L_L$ are connected to control inputs of the gate circuits $G_A$ to $G_L$, respectively. For example, the normally open fixed contacts of key switches $S_{1A}$, $S_{2A}$ and $S_{3A}$ (not shown) are connected to the note line $L_A$, the normally open fixed contacts of key switches $S_{1B}$, $S_{2B}$ and $S_{3B}$ (not shown) are connected to the note line $L_B$, and the normally open fixed contacts of key switches $S_{1L}$ and $S_{2L}$ (either not shown) and $S_{3L}$ are connected to the gate line $L_L$. The octave lines $L_1$ to $L_3$ are connected respectively through diodes $D_3$ to a trigger signal generator 35 including a normally conductive transistor $Q_1$ and a normally nonconductive transistor $Q_2$.

The construction and operation of the trigger signal generator 35 is as follows. When a key is not depressed, diodes $D_3$ are OFF and +15V is applied to the base of transistor $Q_1$ via diode $D_4$ to cause $Q_1$ to be turned ON. In consequence, the collector potential of transistor $Q_1$ becomes 0 volts, causing transistor $Q_2$ to be turned OFF. A trigger signal, i.e. the potential on the collector of transistor $Q_2$, becomes +15V. When a key is depressed, the cathode of a diode $D_3$ becomes 0 volts and no current flow through the base of transistor $Q_1$ and in consequence both diode $D_4$ and transistor $Q_1$ are rendered OFF. As a result, the potential on the collector of transistor $Q_1$ goes to +15V, transistor $Q_2$ is turned ON and the trigger signal becomes 0 volts. The various biasing resistors $r_4$–$r_8$ and the capacitor $C_1$ are conventional.

The operation of the electronic musical instrument shown in FIG. 3 will be explained below.

The respective gate circuits are each designed to be enabled when a potential on the control input of the respective gate circuits becomes a ground potential. When, therefore, no key is depressed on the keyboard 34, all the gate circuits are disabled. When, for example, the key switch $S_{1A}$ in the lowest octave is actuated, the normally open fixed contact of the key switch $S_{1A}$ is connected to ground through the serially connected key switches. In consequence, a potential on the lines $L_A$ and $L_1$ becomes the ground potential and the gate circuits $G_A$ and $G_1$ are enabled. A pitch determining voltage signal having a magnitude corresponding to the note C in the lowest octave is coupled from the output point $O_A$ through the gate circuit $G_A$ and buffer amplifier 31 to the voltage converter 32. Since in the voltage converter 32 only the gate circuit $G_1$ is enabled, an output voltage at the $\frac{1}{4}$ voltage dividing point $O_1$, which has a magnitude corresponding to the note C in the lowest octave, is coupled to VCO 33. When the key switch $S_{2A}$ corresponding to the note C in the second octave is actuated, the gate circuits $G_A$ and $G_2$ are enabled. As a result, an output voltage at the $\frac{1}{2}$ voltage dividing point $O_2$, which has a magnitude corresponding to the note C in the second octave, is coupled to VCO 33. When the key switch $S_{3A}$ (not shown) in the highest octave is actuated the gate circuits $G_A$ and $G_3$ are enabled. At this time, a pitch determining voltage signal having a magnitude corresponding to the note C in the highest octave is coupled from the output point $O_A$ through the gate circuit $G_A$, buffer amplifier 31 and gate circuit $G_3$ to VCO 33.

When the key switch $S_{2B}$ is actuated the lines $L_B$ and $L_2$ are at the ground potential and in consequence the gates $G_B$ and $G_2$ are enabled. A pitch determining voltage signal at the output point $O_B$, which has a magnitude corresponding to the note C# in the highest octave, is coupled to the voltage converter 32. At this time, since the gate $G_2$ in the voltage converter 32 is enabled, an output voltage at the $\frac{1}{2}$ voltage dividing point $O_2$, which has a magnitude corresponding to the note C# in the second octave, is coupled to VCO 33.

Upon depressing a key on the keyboard 34 either one of the octave lines $L_1$ to $L_3$ is biased to the ground potential. In consequence, the base of transistor $Q_1$ in the trigger signal generator 35 is biased to the ground potential and the transistor $Q_1$ is rendered nonconductive. As a result, the transistor $Q_2$ is rendered conductive. That is, when a key is depressed on the keyboard a trigger signal of ground potential, which represents the key depression, is obtained from the collector of transistor $Q_2$.

As mentioned above, the electronic musical instrument of this invention can prominently reduce the number of resistors necessary to generate pitch determining voltage signals over a plurality of octaves which exponentially vary in the order of tonal pitch, by combination of a pitch determining voltage signal generating circuit for generating pitch determining voltage signals corresponding to 12 notes with a voltage converter.

Figure 4:
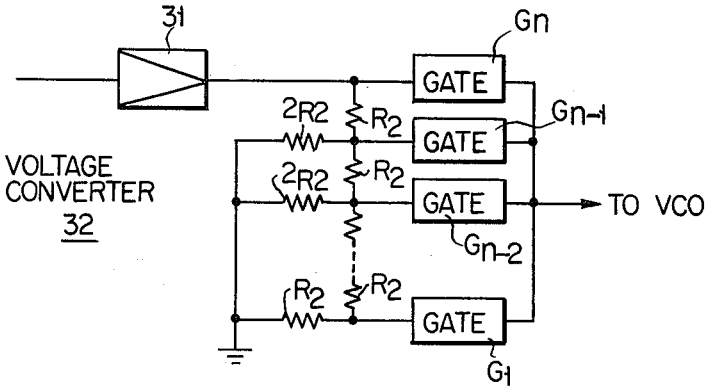
FIG. 4 shows a voltage converter for n octave ranges.

FIG. 4 shows a configuration of the voltage converter in which the compass of the keyboard ranges over n octaves.

Figure 5:
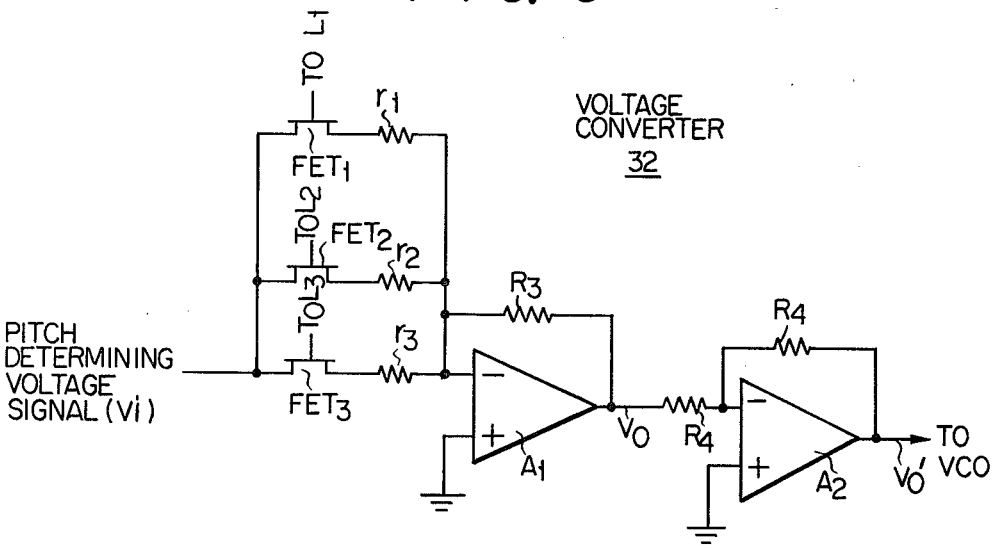
FIG. 5 shows another configuration of voltage converter.

The voltage converter 32 may be constructed using a variable gain amplifier as shown in FIG. 5. A plurality of series circuits are connected between the negative input of an operational amplifier $A_1$ and the pitch determining voltage signal generating circuit 30, and, each, includes a switching element, for example, a field effect transistor (FET) and a resistor. The gate of $FET_1$ connected in series with the resistor $r_1$ is connected to the octave line $L_1$, the gate of $FET_2$ connected in series with the resistor $r_2$ is connected to the octave line $L_2$, and the gate of $FET_3$ connected in series with the resistor $r_3$ is connected to the octave line $L_3$. A relation of a resistive value between resistors $r_1$, $r_2$, $r_3$ and a resistor $R_3$ connected between the output and negative input of the operational amplifier $A_1$ is selected as follows:

$$r_1 = 4R_3$$

$$r_2 = 2R_3$$

$$r_3 = R_3$$

When a key belonging to the lowest octave is depressed on the keyboard, $FET_1$ is rendered ON and an output voltage $V_0$ of the amplifier $A_1$ becomes $$V_0 = -(R_3/r_1)\,V_i = -\tfrac{1}{4}V_i$$

Since the gain of the operational amplifier $A_2$ is selected to be unity, an output voltage $V_0'$ of the amplifier $A_2$ becomes $$V_0' = -V_0 = \tfrac{1}{4}V_i$$

When a key belonging to the second octave is depressed on the keyboard, $FET_2$ is rendered conductive and the output voltage $V_0'$ of the amplifier $A_2$ becomes $$V_0' = (R_3/r_2)V_i = \tfrac{1}{2}V_i$$

When a key belonging to the highest octave is depressed on the keyboard, $FET_3$ is turned ON and $$V_0' = (R_3/r_3)V_i = V_i$$

That is, the voltage converter can be constructed using a variable gain amplifier whose voltage gain is controlled dependent upon the octave range to which a key being depressed on the keyboard belongs.

Figure 6:
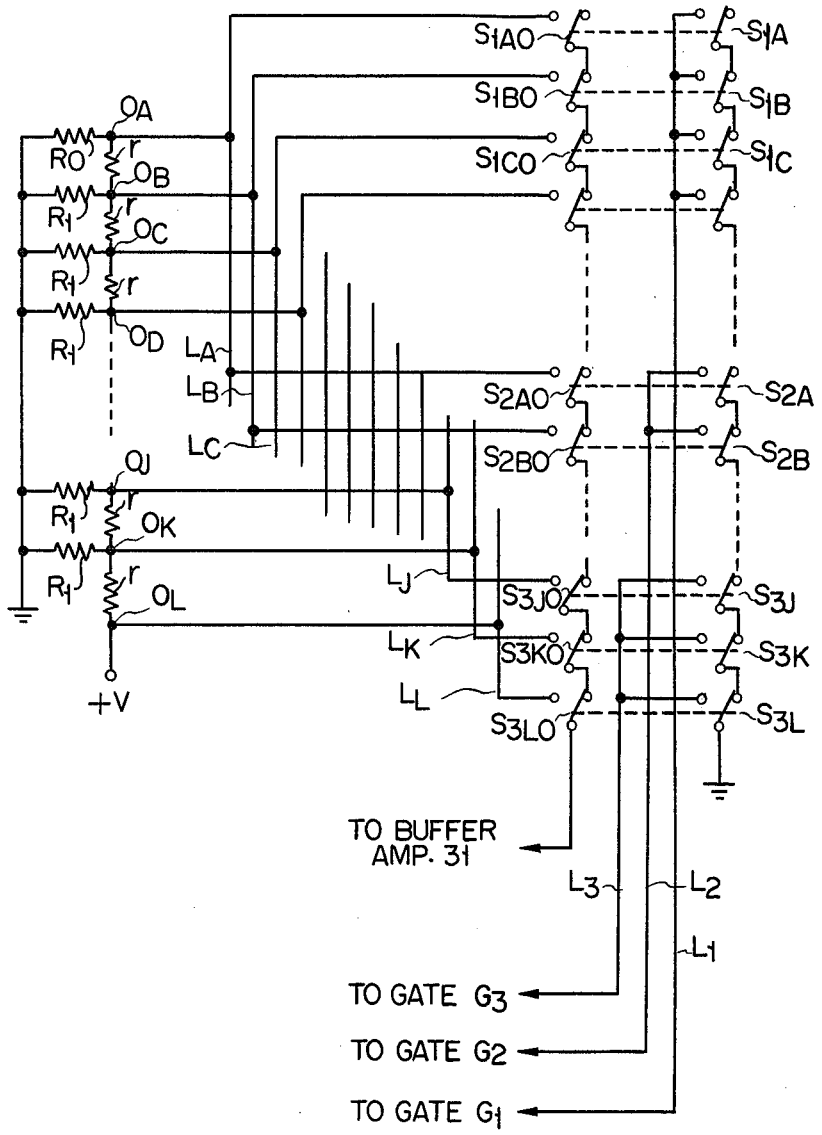
FIG. 6 is a modification of FIG. 3.

The keyboard circuit in FIG. 3 can be modified as shown in FIG. 6 to omit the gate circuits $G_A$ to $G_L$. That is, in addition to a first key switch arrangement including key switches $S_{1A}$, $S_{1B}$ . . . $S_{3K}$ and $S_{3L}$ there is also provided a second key switch arrangement including key switches $S_{1A0}$, $S_{1B0}$ . . . $S_{3K0}$ and $S_{3L0}$ which are serially connected as in the case of the key switches $S_{1A}$ to $S_{3L}$. Any key switch in the first key switch arrangement is ganged with the corresponding key switch in the second key switch arrangement. Output points $O_A$ to $O_L$ of the voltage dividing resistance network are connected directly to lines $L_A$ . . . $L_L$, respectively. The lines $L_A$ to $L_L$ are connected to the normally open fixed contacts of those key switches in the second key switch arrangement which are actuated by keys belonging to different octave ranges and having the same note. That is, the line $L_A$ is connected to the normally open fixed contacts of the key switches $S_{1A0}$, $S_{2A0}$ and $S_{3A0}$ (not shown) and the line $L_B$ is connected to the normally open fixed contacts of the key switches $S_{1B0}$, $S_{2B0}$ and $S_{3B0}$ (not shown). The movable contact of the key switch $S_{3L0}$ is connected to the buffer amplifier 31. It will be apparent that the embodiment in FIG. 6 is operated in the same way as in the embodiment in FIG. 3, without the necessity of using the gate circuits $G_A$ to $G_L$.

What we claim is:

1. An electronic musical instrument comprising:

keyboard means having keys over a plurality of octave ranges and generating, in response to a depressed key, both note information and octave information corresponding to said depressed key;

voltage signal generating means operatively coupled to said keyboard means for generating a first voltage signal which is a function of one of said note information and said octave information;

voltage converting means coupled to an output of said voltage signal generating means and operatively coupled to said keyboard means for generating a second voltage signal having a magnitude corresponding to the note and octave of said depressed key in response to said first voltage signal and in response to the other of said note information and said octave information; and voltage controlled oscillator means coupled to an output of said voltage converting means for generating a tone signal corresponding to said depressed key.

2. An electronic musical instrument according to claim 4, wherein said voltage signal generating means generates said first voltage signal as a function of said note information, and said voltage converting means generates said second voltage signal as a function of said octave information.

3. An electronic musical instrument according to claim 2, in which said voltage converting means includes a variable gain amplifier means whose voltage gain is controlled dependent upon the octave range to which the key being depressed belongs.

4. An electronic musical instrument comprising:

keyboard means having keys over a plurality of octave ranges;

pitch determining voltage signal generating means operatively coupled to said keyboard means for generating one of 12 pitch determining voltage signals having different magnitudes corresponding to 12 notes in one octave range in response to the depression of any one of keys belonging to different octave ranges and having the same note;

voltage converting means coupled to an output of said pitch determining voltage signal generating means and operatively coupled to said keyboard means for generating a note-and-octave determining voltage signal having a magnitude corresponding to the note of a key being depressed in response to the octave range to which the key being depressed belongs and the pitch determining voltage signal common to the different octave ranges supplied from said pitch determining voltage signal generating means; and voltage-controlled oscillator means coupled to an output of said voltage converting means and responsive to said note-and-octave determining voltage signal for generating a tone signal corresponding to the key being depressed.

5. An electronic musical instrument according to claim 4, in which said voltage converting means includes a voltage dividing network having a plurality of output points, and a plurality of gate circuits connected between the respective output points and the output of said voltage converting means and corresponding to the respective octave ranges in said keyboard means, each of said gate circuits being enabled in response to the depression of a key in the corresponding octave range.

6. An electronic musical instrument according to claim 4, in which said voltage converting means includes a variable gain amplifier means whose voltage gain is controlled dependent upon the octave range to which the key being depressed belongs.

* * * * *